US010132305B2

(12) United States Patent
Patel et al.

(10) Patent No.: US 10,132,305 B2
(45) Date of Patent: Nov. 20, 2018

(54) VARIABLE SPEED MULTI-PUMP APPLICATION FOR PROVIDING ENERGY SAVING BY CALCULATING AND COMPENSATING FOR FRICTION LOSS USING SPEED REFERENCE

(71) Applicant: Fluid Handling LLC., Morton Grove, IL (US)

(72) Inventors: Pradipkumar B. Patel, Mount Prospect, IL (US); James J. Gu, Buffalo Grove, IL (US)

(73) Assignee: Fluid Handling LLC, Morton Grove, IL (US)

( * ) Notice: Subject to any disclaimer, the term of this patent is extended or adjusted under 35 U.S.C. 154(b) by 693 days.

(21) Appl. No.: 14/591,240

(22) Filed: Jan. 7, 2015

(65) Prior Publication Data

US 2015/0300346 A1 Oct. 22, 2015

Related U.S. Application Data

(60) Provisional application No. 61/924,393, filed on Jan. 7, 2014.

(51) Int. Cl.
*F04D 1/00* (2006.01)
*F04D 13/12* (2006.01)
(Continued)

(52) U.S. Cl.
CPC ..... *F04B 49/065* (2013.01); *F04B 49/20* (2013.01); *F04D 13/12* (2013.01);
(Continued)

(58) Field of Classification Search
CPC ..... F04B 49/20; F04B 49/065; F04D 1/00; F04D 13/12; F04D 15/066; F04C 15/066
(Continued)

(56) References Cited

U.S. PATENT DOCUMENTS 3,565,286 A 2/1971 Latham, Jr.
3,977,805 A 8/1976 Wanous
(Continued)

FOREIGN PATENT DOCUMENTS

CN 102587007 A 7/2012
CN 103370538 A 10/2013
(Continued)

OTHER PUBLICATIONS

"Hydro MPC-E BoosterpaQ (Integrated VFD/Motor) Guide Specification" Grundfos http://net.grundfos.com/doc/webnet/boosterpaq/Spec%20Sheets/BoosterpaQ_MPCE_ Integrated_VFD-Motor_Spec.doc. Oct. 2012.
(Continued)

*Primary Examiner* — Ryan D. Coyer
(74) *Attorney, Agent, or Firm* — Ware, Fressola, Maguire & Barber LLP

(57) ABSTRACT

Apparatus features a signal processor or processing module configured to respond to signaling containing information about a set point and a speed related to one or more pumps in a pump system, e.g., including a variable speed multiple pump booster system, operating at a substantially constant discharge pressure; and determine an adjustment to the set point to compensate for system friction loss and maintain the substantially constant discharge pressure of the variable speed multiple pump booster system for flow variation, based at least partly on the signaling received. The signal processor or processing module 10*a* provides corresponding signaling containing information to control the one or more pumps in the variable speed multiple pump booster system.

21 Claims, 4 Drawing Sheets

(51) Int. Cl.
*F04D 15/00* (2006.01)
*F04B 49/20* (2006.01)
*F04B 49/06* (2006.01)

(52) U.S. Cl.
CPC .. *F04D 15/0066* (2013.01); *F04B 2203/0201* (2013.01); *F04B 2203/0209* (2013.01); *F04B 2205/05* (2013.01); *F04D 1/00* (2013.01)

(58) Field of Classification Search
USPC ..... 700/282
See application file for complete search history.

(56) References Cited

U.S. PATENT DOCUMENTS

| | | | | |
|---|---|---|---|---|
| 3,977,809 | A | 8/1976 | Petit | |
| 5,026,256 | A | 6/1991 | Kawabara et al. | |
| 5,215,448 | A | 6/1993 | Cooper | |
| 5,698,031 | A | 12/1997 | Winkle | |
| 6,257,833 | B1 * | 7/2001 | Bates | F04B 41/06 417/17 |
| 6,260,004 | B1 | 7/2001 | Hays et al. | |
| 6,325,093 | B1 | 12/2001 | Ooshima | |
| 6,330,525 | B1 | 12/2001 | Hays et al. | |
| 6,709,241 | B2 * | 3/2004 | Sabini | F04D 15/0066 417/43 |
| 6,721,683 | B2 | 4/2004 | Harris et al. | |
| 7,539,549 | B1 * | 5/2009 | Discenzo | F04D 15/0077 324/765.01 |
| 8,417,360 | B2 | 4/2013 | Sustaeta et al. | |
| 2007/0041845 | A1 * | 2/2007 | Freudenberger | F04B 13/00 417/63 |
| 2008/0095652 | A1 | 4/2008 | Jiang | |
| 2008/0142614 | A1 | 6/2008 | Elezaby | |
| 2008/0288115 | A1 * | 11/2008 | Rusnak | F04D 15/0066 700/282 |
| 2010/0017099 | A1 * | 1/2010 | Becker | F02D 41/2464 701/103 |
| 2010/0194111 | A1 | 8/2010 | Van Den Bossche et al. | |
| 2012/0173027 | A1 * | 7/2012 | Cheng | F04D 15/0088 700/282 |
| 2013/0259711 | A1 | 10/2013 | Burggraf et al. | |
| 2014/0309796 | A1 * | 10/2014 | Mueller | F04B 17/04 700/282 |

FOREIGN PATENT DOCUMENTS

| | | |
|---|---|---|
| EP | 2365915 | 9/2011 |
| GB | 856258 | 12/1960 |
| WO | 2010065476 | 6/2010 |
| WO | 2013059764 | 4/2013 |

OTHER PUBLICATIONS

"A. Bhatia, B.E. "Design Considerations for Hydronic Pump System Design" PDHonline Course M150 (5PDH), PDH Online | PDH Center, 2012 http://www.pdhonline.org/courses/nn150/nn150content.pdf ".

Ahonen "Sensorless frequency-converter-based methods for realizing lifecycle cost efficient pumping and fan systems" Institute of Energy Technology, Lappeenranta University of Technology, Finland. In particular, see http://www.eemods2013.org/paper/Oct28/Session%201.c/Papers/071_Ahonen_finalpaper_EEMODS13.pdf.

Description not available for EP2365915—83 pages Description of corresponding document: WO2010065476.

Dan Foss, VLT HVAC Drive Application Guide, Dec. 2011 (Dec. 2011) [retrieved on Mar. 14, 2015 (Mar. 14, 2015)]. Retrieved from the Internet<URL: https://www.taco-hvac.com/uploads/FileLibrary/Danfoss_VLT_HVAC_Drive_Application_Guide.pdf>pp. 66-72.

Danfoss, "VLT HVAC Drive Drive Applications Note", Literature Group Frequency Converters, Version 1, MG11T141,30685, VLT HVAC Drive FC 102, Apr. 30, 2008. (pp. 74, 75 & 82).

* cited by examiner

| | |
|---|---|
| ———— | 1 Pump @ 100% Speed |
| - - - - - - | 1 Pump @ Minimum % Speed |
| ····· | 2 Pump @ 100% Speed |
| - · - · - · | 2 Pump @ Destage % Speed |
| ———— | 3 Pump @ 100% Speed |
| - - - - - - | 3 Pump @ Destage % Speed |

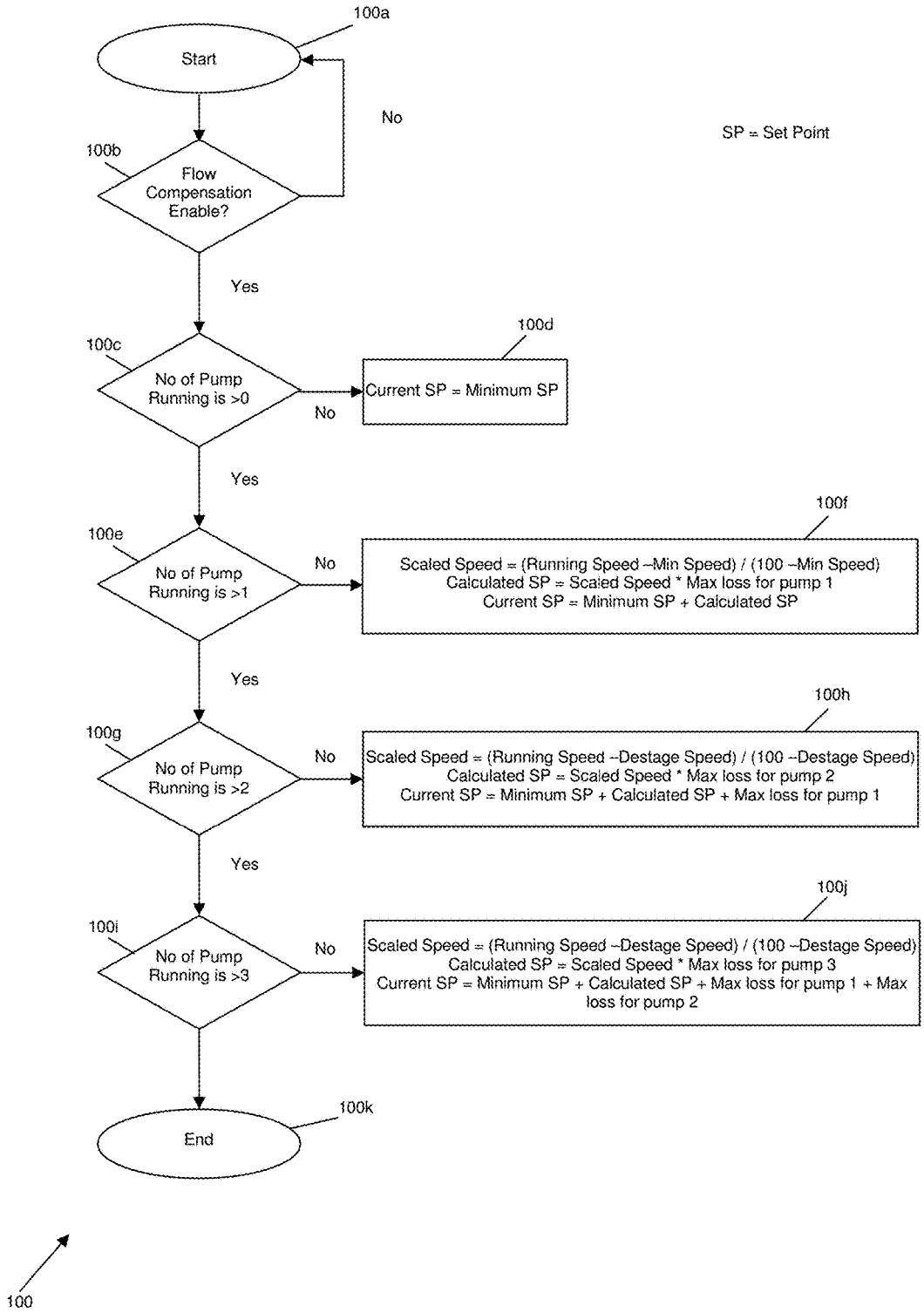
Figure 3: Flow Compensation Flow Chart for a Three (3) Pump System

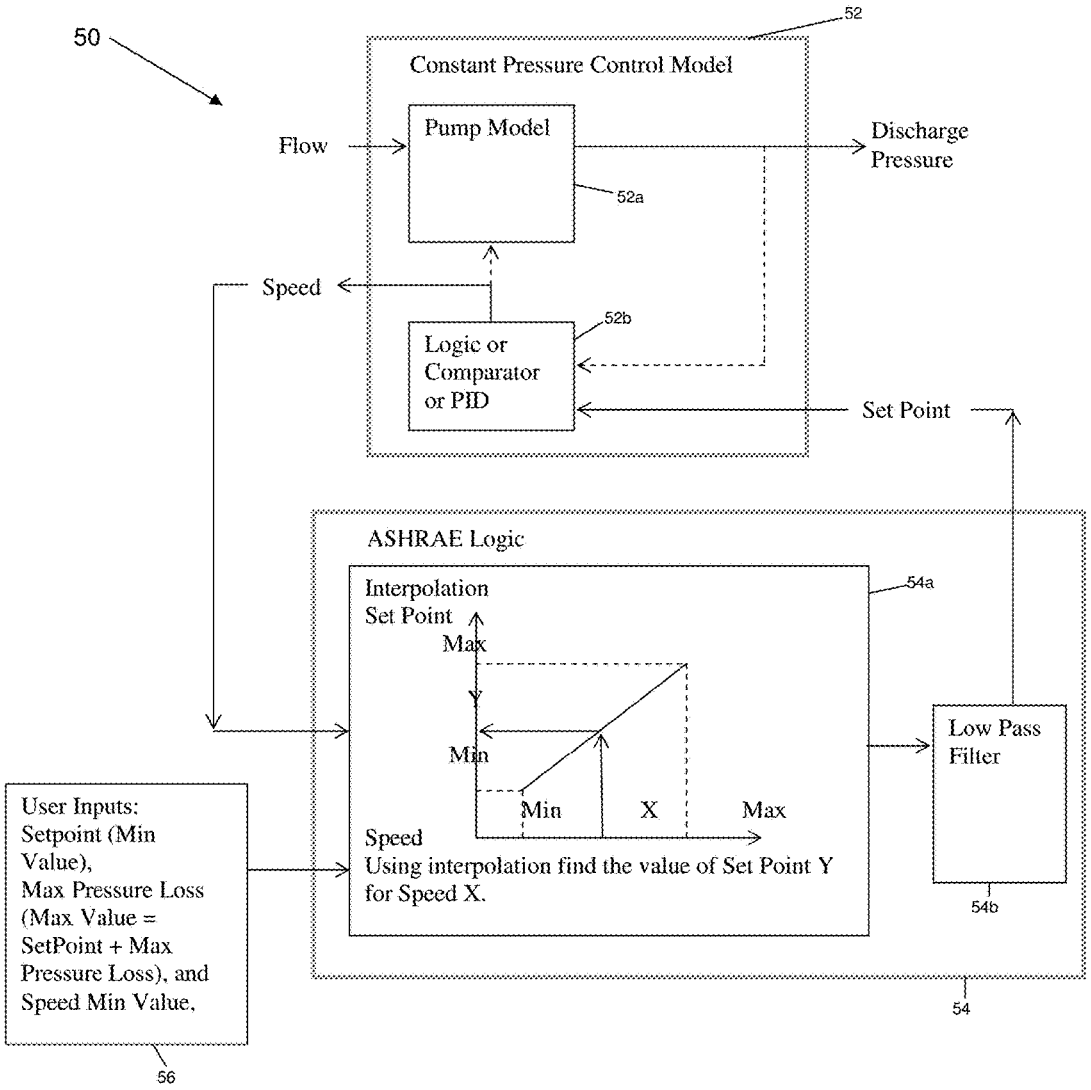
Figure 4: A Pump System 50

VARIABLE SPEED MULTI-PUMP APPLICATION FOR PROVIDING ENERGY SAVING BY CALCULATING AND COMPENSATING FOR FRICTION LOSS USING SPEED REFERENCE

CROSS REFERENCE TO RELATED APPLICATION

This application claims benefit to U.S. provisional application No. 61/924,393, filed 7 Jan. 2014, entitled "Additional Energy Saving in the Variable Speed Multi-Pump Application through the Calculating and Compensation the Friction Loss by Using Speed Reference," which is hereby incorporated by reference in its entirety.

BACKGROUND OF THE INVENTION

1. Field of the Invention

The present invention relates to a technique for controlling the operation of a pump in a pump system; and more particularly, the present invention relates to a method and apparatus for controlling and/or monitoring one or more pumps in a variable speed multi-pump booster application, e.g., including for domestic water systems.

2. Brief Description of Related Art

In a variable speed multi-pump booster application, a pressure sensor is used and connected at a discharge line of a booster package, where it measures and maintains constant discharge pressure. Since friction loss in a system varies with flow changes, normally, the system will have exceeded pressure at a low flow demand. As a result, the system uses more energy than it otherwise requires. When a flow meter is available, the friction loss can be determined by using the flow value.

SUMMARY OF THE INVENTION

In summary, in a variable speed multi-pump application according to the present invention, a speed reference may be used to calculate the system friction loss, e.g., instead of the flow meter that is otherwise used in the prior art designs. In effect, this method or technique provides a new and unique way to compensate the booster system friction loss without an additional flow meter.

PARTICULAR EMBODIMENTS

According to some embodiments, the present invention may include, or take the form of, apparatus featuring a signal processor or processing module configured at least to:

- respond to signaling containing information about a set point and a speed related to one or more pumps in a pump system, including a variable speed multiple pump booster system, operating at a substantially constant discharge pressure; and
- determine an adjustment to the set point to compensate for system friction loss and maintain the substantially constant discharge pressure of the pump system for flow variation, based at least partly on the signaling received.

The apparatus may include, or take the form of, a pump system controller having the signal processor or processing module configured therein, as well as a pump system, such as a variable speed multiple pump booster system, having such a pump system controller with the signal processor or processing module configured therein, consistent with that set forth herein.

Embodiments of the present invention may also include one or more of the following features:

The signal processor or processing module may be configured to provide corresponding signaling containing information to control one or more pumps in a pump system, such as a variable speed multiple pump booster system.

The signal processor or processing module may be configured to determine the adjustment to the set point using an interpolation based at least partly on a relationship between a minimum set point for a minimum speed and a maximum set point for a maximum speed so as to find a value of an adjusted set point for the speed.

The signal processor or processing module may form part of one or more logic modules, or a comparator, or a proportional integral derivative (PID) controller.

The signal processor or processing module may be configured to determine the number of the one or more pumps running in the variable speed multiple pump booster system and a defined control area related to the one or more pumps running.

The signal processor or processing module may be configured to determine the adjustment, based at least partly on the number of the one or more pumps running in the variable speed multiple pump booster system and the defined control area related to the one or more pumps running.

By way of example, the signal processor or processing module may include, or take the form of, at least one processor and at least one memory including computer program code, and the at least one memory and computer program code are configured to, with at least one processor, to cause the signal processor or processing module at least to receive the signaling and determine the adjustment to the set point. The signal processor or processing module may be configured with suitable computer program code in order to implement suitable signal processing algorithms and/or functionality, consistent with that set forth herein.

The adjustment to the set point may be determined without using a flow meter, e.g., containing information based on the speed of pump.

The signal processor or processing module may also be configured to determine a max pressure loss of the pump system and a defined control area of each pump; and determine a max loss of the one or more pumps, based upon the max pressure loss of the pump system and the defined control area of each pump. The signal processor or processing module may also be configured to determine a value of max loss of the one or more pumps that can be used to define the shape of setpoint control curve.

According to some embodiments, the present invention may take the form of a method including steps for: responding with a signal processor or processing module to signaling containing information about a set point and a speed related to one or more pumps in a pump system, e.g., including a variable speed multiple pump booster system, operating at a substantially constant discharge pressure; and determining with the signal processor or processing module an adjustment to the set point to compensate for the system friction loss and maintain the substantially constant discharge pressure of the variable speed multiple pump booster system for flow variation, based at least partly on the signaling received.

The present invention may also, e. g., take the form of a computer program product having a computer readable medium with a computer executable code embedded therein for implementing the method, e.g., when run on a signaling processing device that forms part of such a pump controller. By way of example, the computer program product may, e.g., take the form of a CD, a floppy disk, a memory stick, a memory card, as well as other types or kind of memory devices that may store such a computer executable code on such a computer readable medium either now known or later developed in the future.

BRIEF DESCRIPTION OF THE DRAWING

The drawing includes the following Figures, which are not necessarily drawn to scale:

FIG. 3 is a flow compensation flow chart for a three (3) pump system having steps for implementing a method according to some embodiments of the present invention.

FIG. 4 is a block diagram of apparatus in the form of a pump system, according to some embodiments of the present invention.

DETAILED DESCRIPTION OF THE INVENTION

FIG. 1

Figure 1:
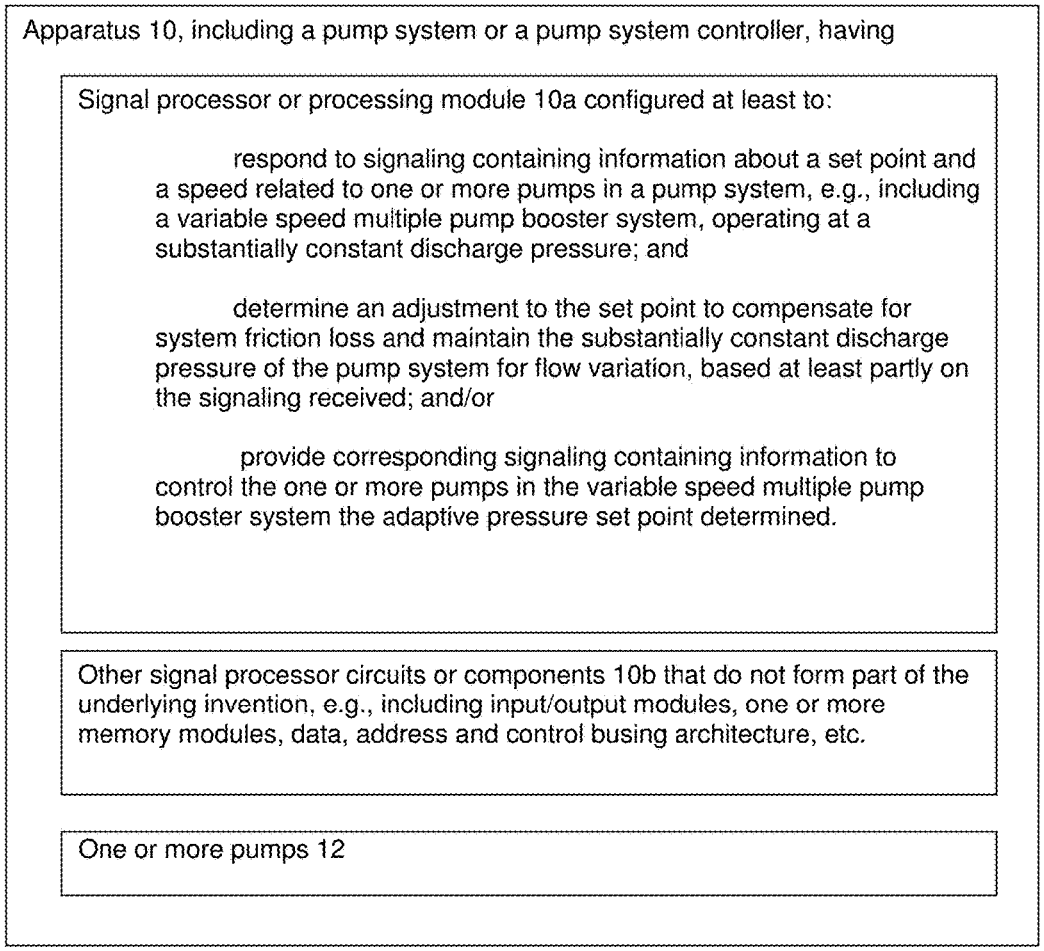
FIG. 1 is a block diagram of apparatus, e.g., having a signal processor or processing module configured for implementing the signal processing functionality, according to some embodiments of the present invention.

By way of example, FIG. 1 shows apparatus 10 according to some embodiments of the present invention, e.g., featuring a signal processor or processing module 10*a* configured at least to:

respond to signaling containing information about a set point (SP) and a speed related to one or more pumps 12 in a pump system 50 (FIG. 4), e.g., including a variable speed multiple pump booster system, operating at a substantially constant discharge pressure; and determine an adjustment to the set point to compensate for system friction loss and maintain the substantially constant discharge pressure of the pump system (e.g., such as the variable speed multiple pump booster system) for flow variation, based at least partly on the signaling received.

The signal processor or processing module 10*a* may be configured to provide corresponding signaling containing information to control the one or more pumps 12, e.g., in the variable speed multiple pump booster system.

By way of example, the apparatus 10 may include, or take the form of, a pump system controller having the signal processor or processing module 10*a* configured therein for controlling the operation of the one or more pumps 12, as well as a pump system like element 50 (FIG. 4), such as a variable speed multiple pump booster system, having such a pump system controller with the signal processor or processing module 10*a* configured therein, consistent with that set forth herein. By way of still further example, the pump system may include, or take the form of, the pump system, e.g., like that shown in FIG. 4.

The present invention is described in relation to a pump system such as a variable speed multiple pump booster system operating at a substantially constant discharge pressure; however, the scope of the invention is intended to include other types or kinds of pump systems operating at a substantially constant discharge pressure that are either now known or later developed in the future.

The signal processor or processing module 10*a* may be configured to operate in conjunction with other signal processor circuits or components 10*b*.

FIGS. 2-3

Figure 2:
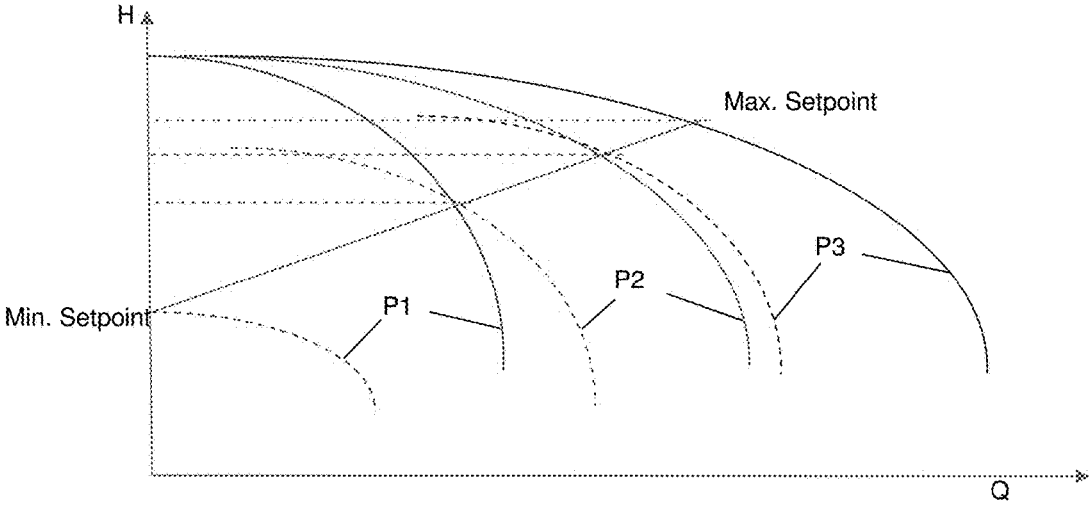
FIG. 2 is a graph of flow rate Q (e.g., in gpm) versus head pressure H (e.g., in Ft or psi), showing 100% speed and a minimum % speed for three pumps 1, 2, and 3 in relation to minimum and maximum set points.

As a person skilled in the art would appreciate, flow in a pump is understood to be proportional to speed as per the affinity laws. But in a variable speed multi-pump booster system, it is challenging to use a speed reference to estimate system flow because it also depends on the number of pumps that are running at any given time. In the variable speed multi-pump booster application, an optimal staging and destaging method determines the number of pumps in operation and their entire control area, e.g., see the graph shown in FIG. 2. Based on the defined control area and the number of pumps, the system may be able to make a set point adjustment to compensate for system friction loss and maintain the constant pressure in the system for the flow variation, e.g., consistent with that set forth herein.

Set Point (Min Value):

The set point (min value) is a pressure value which should be delivered at a minimum flow (or at no flow). Theoretically, pressure loss will be zero at no flow (or at very minimum flow). So in other words one can say that the set point is the pressure value which is required to maintain a desired constant at the user end.

Max Pressure Loss:

The maximum pressure loss is a pressure loss (e.g., from the system friction loss in a pipe or distribution network) in the system at a maximum flow.

There are at least two ways to find this value.

1. Calculate the system friction loss for maximum flow based on the pipe and fitting components used in the pipe or distribution network.
2. Allow the system to run in a full flow demand condition then measure the pressure at a pump discharge point and at a user end, where the difference between those two values should be the maximum pressure loss.

Speed Min Value:

The speed minimum value is a speed at which one pump is running in a no flow (or at very minimum flow) demand condition and still achieving the discharge pressure above the set point (Min value). Ideally this value should be same as the variable frequency drive (VFD) minimum speed. In operation, a controller is typically implemented not accept a value less than the VFD minimum speed.

By way of example, FIG. 3 shows a flow compensation flow chart for a three (3) pump system generally indicated as 100 having steps 100*a*, 100*b*, 100*c*, . . . , 100*k* for implementing a method or process, according to some embodiments of the present invention. The steps 100*a*, 100*b*, 100*c*, . . . , 100*k* may be implemented, e.g., using the signal processor or processing module 10*a* in conjunction with signal processor circuits or components 10*b*, consistent with that described herein.

By way of example, in step 100*a*, the method is started, which may include some introductory steps and initialization as would be appreciated by a person skilled in the art, e.g., as well as enabling a flow compensation technique consistent with that set forth herein.

In step 100*b*, the signal processor or processing module 10*a* determines if flow compensation is enabled. If not, then the start step 100*a* is re-implemented.

In step 100*c*, with flow compensation enabled the signal processor or processing module 10*a* determines if the number of pumps running is greater than 0. If not (i.e., the number of pumps running is 0), then in step 100*d* the signal processor or processing module 10*a* sets:

Current SP=Minimum SP.

In step 100*e*, the signal processor or processing module 10*a* determines if the number of pumps running is greater than 1. If not (i.e., the number of pumps running is 1), then in step 100*f* the signal processor or processing module 10*a* sets:

Scaled Speed=(Running Speed−Minimum Speed)/(100−Minimum Speed),

Calculated SP=Scaled Speed*Max Loss for Pump 1, and

Current SP=Minimum SP+Calculated SP.

In step 100*g*, the signal processor or processing module 10*a* determines if the number of pumps running is greater than 2. If not (i.e., the number of pumps running is 2), then in step 100*h* the signal processor or processing module 10*a* sets:

Scaled Speed=(Running Speed−Destage Speed)/(100−Destage Speed),

Calculated SP=Scaled Speed*Max Loss for Pump 2, and

Current SP=Minimum SP+Calculated SP+Max Loss for Pump 1.

In step 100*i*, the signal processor or processing module 10*a* determines if the number of pumps running is greater than 3. If not (i.e., the number of pumps running is 3), then in step 100*j* the signal processor or processing module 10*a* sets:

Scaled Speed=(Running Speed−Destage Speed)/(100−Destage Speed),

Calculated SP=Scaled Speed*Max Loss for pump 2, and

Current SP=Minimum SP+Calculated SP+Max Loss for pump 1+Max Loss for Pump 2.

In step 100*k*, the method is ended.

Maximum Loss of One or More Pumps 1, 2 and 3:

The signal processor or processing module 10*a* may also be configured to determine the maximum loss of one or more pumps 1, 2 and 3, e.g., based upon the maximum pressure loss of the pump system and the defined control area of each pump. As a person skilled in the art would appreciate, the value of maximum loss of the one or more pumps 1, 2 and 3 may be used to define the shape of setpoint control curve, e.g., consistent with that shown in FIG. 2.

FIG. 4

FIG. 4 shows apparatus in the form of a pump system 50 (e.g., including a variable speed multiple pump booster system) that may include a constant pressure control model 52 in combination with an ASHRAE (American Society of Heating, Refrigerating, and Air-Conditioning Engineers) logic module 54, according to some embodiments of the present invention. The constant pressure control model 52 may include a pump model 52*a* in combination with a logic, or comparator, or PID controller module 52*b*. The pump model 52*a* may include, contain, or take the form of, the one or more running pumps 12 (FIG. 1), as well as multiple pumps running in a multiple pump system that may be staged and destaged during the operation of the pump system. The ASHRAE logic module 54 may include an interpolation set point module 54*a* and a low pass filter module 54*b*.

In operation, the constant pressure control model 52 may be configured to receive a flow from a pipe or distribution network that may be processed and pumped back into the pipe or distribution network; and the constant pressure control model 52 may also be configured to respond to set point signaling from the ASHRAE logic module 54, pump the flow at a substantially constant discharge pressure, and provide a speed signal containing information about the speed related to the constant pressure control model 52. The ASHRAE logic module 54 may be configured to receive user inputs 56, e.g., containing information about a set point (minimum value), a maximum pressure loss (e.g., where Max Pressure Value=Set Point+Max Pressure Loss) and a Speed minimum value, and may also be configured to receive the speed signaling from the constant pressure control model 52, and provide the set point signaling to the constant pressure control model 52.

In particular, the interpolation set point module 54*a* may be configured to respond to user input signaling containing information about the user inputs, and also to respond to the speed signaling from the constant pressure control model 52, use interpolation to find the value of a set point Y for a speed X, and provide interpolation signaling containing information about the value of the set point Y for the speed X, consistent with that shown in FIG. 4. The interpolation set point module 54*a* shown in FIG. 4 includes an illustration of a graph having speed along the X axis and set point along the Y axis, which forms the basis for, and visually characterizes, the interpolation determination process performed therein. The low pass filter module 54*b* may be configured to respond to the interpolation signaling and provide low pass filter interpolation signaling containing low pass filtered information about the interpolation related to the value of the set point Y for the speed X that takes the form of the set point signaling provided to the constant pressure control model 52, consistent with that shown in FIG. 4.

The logic, or comparator, or PID controller module 52*b* may be configured to respond to the set point signaling, determine the speed signaling (e.g., based at least partly upon the value of the set point Y for the speed X), provide/feed the speed signaling back to the ASHRAE logic module 54, and also provide the speed signaling to the pump model 52*a* to control the speed of the one or more pumps operating in the pump model 52*a*. The pump model 52*a* is configured to receive the flow from the pipe or distribution network and also configured to respond to the set point signaling and pump the flow at the substantially constant discharge pressure. In FIG. 4, the pump model 52*a* is also shown to include a dashed line which visually indicates that some information about the discharge pressure, e.g., contained in suitable discharge pressure signaling, may be fed back to the logic, or comparator, or PID controller module 52*b*. In such a case, the logic, or comparator, or PID controller module 52*b* may also be configured to respond to such suitable discharge pressure signaling and determine the speed signaling, e.g., based at least partly on the discharge pressure signaling received.

By way of example, the functionality of the signal processor or processing module 10*a* may be implemented using part of the functionality implemented by the logic, or comparator, or PID controller module 52*b* related to generating the speed signaling in combination with part of the functionality implemented by the interpolation set point module 54*a* related to adapting/adjusting the set point to compensate for the system friction loss in the pipe or distribution network in the variable speed multiple pump booster system. In other words, the functionality of the logic, or comparator, or PID controller module 52*b* and the interpolation set point module 54*a* may be implemented in one processing module, so as to include and implement the functionality of the signal processor or processing module 10*a*, according to some embodiments of the present invention.

The Signal Processor or Processing Module 10*a*

By way of example, the functionality of the signal processor or processing module 10*a* may be implemented using hardware, software, firmware, or a combination thereof. In a typical software implementation, the signal processor or processing module 10*a* would include one or more microprocessor-based architectures having, e. g., at least one signal processor or microprocessor like element 10*a*. A person skilled in the art would be able to program such a microcontroller-based, or microprocessor-based, implementation to perform the functionality described herein without undue experimentation. For example, the signal processor or processing module 10*a* may be configured, e.g., by a person skilled in the art without undue experimentation, to respond to signaling containing information about a set point and a speed related to one or more pumps in a pump system, e.g., including a variable speed multiple pump booster system, operating at a substantially constant discharge pressure, consistent with that disclosed herein.

Moreover, the signal processor or processing module 10*a* may be configured, e.g., by a person skilled in the art without undue experimentation, to determine an adjustment to the set point to compensate for system friction loss and maintain the substantially constant discharge pressure of the variable speed multiple pump booster system for flow variation, based at least partly on the signaling received, consistent with that disclosed herein.

The scope of the invention is not intended to be limited to any particular implementation using technology either now known or later developed in the future. The scope of the invention is intended to include implementing the functionality of the processors 10*a* as stand-alone processor or processor module, as separate processor or processor modules, as well as some combination thereof.

The apparatus 10 may also include, e.g., other signal processor circuits or components 10*b*, including random access memory (RAM) and/or read only memory (ROM), input/output devices and control, and data and address buses connecting the same, and/or at least one input processor and at least one output processor.

Other Modules Like 52*b*, 54*a* and 54*b*

The logic, or comparator, or PID controller module 52*b*, the interpolation set point module 54*a* and the low pass filtering module 54*b* may all be implemented with signal processors or signal processing modules using hardware, software, firmware, or a combination thereof, consistent with that set forth in relation to the signal processor or processing module 10*a*.

THE SCOPE OF THE INVENTION

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the present invention is described by way of example in relation to a centrifugal pump, the scope of the invention is intended to include using the same in relation to other types or kinds of pumps either now known or later developed in the future.

Although the invention has been described and illustrated with respect to exemplary embodiments thereof, the foregoing and various other additions and omissions may be made therein and thereto without departing from the spirit and scope of the present invention.

What we claim is:

1. A pump system comprising:

a constant pressure control model having a logic, comparator or proportional integral derivative (PID) controller and a pump model having one or more running pumps, the logic, comparator or PID controller configured to respond to set point signaling and provide speed signaling, the pump model configured to respond to the speed signaling and operate the one or more running pumps operating at a substantially constant discharge pressure; and a pump system logic controller having a signal processor or processing module configured to respond to the speed signaling, and also to user input signaling containing information about a set point and a speed related to running the one or more pumps in the pump system, and determine the set point signaling containing information about an adjustment to the set point to compensate for system friction loss and maintain the substantially constant discharge pressure of the pump system for a flow variation using an interpolation based on a relationship between a minimum set point for a minimum speed and a maximum set point for a maximum speed so as to find a value of an adjusted set point for the speed in order to maintain the substantially constant discharge pressure of the pump system, in response to the speed signaling and the user input signaling received.

2. A pump system according to claim 1, wherein the signal processor or processing module is configured to provide the set point signaling to control the one or more pumps in the constant pressure control model.

3. A pump system according to claim 1, wherein the signal processor or processing module is configured to determine the number of the one or more pumps running in the constant pressure control model.

4. A pump system according to claim 3, wherein the signal processor or processing module is configured to determine the adjustment based at least partly on the number of the one or more pumps running and a defined control area related to the one or more pumps running.

5. A pump system according to claim 1, wherein the pump system comprises a variable speed multiple pump booster system.

6. A pump system according to claim 1, wherein the pump system logic controller comprises an interpolation set point module that is configured to implement the interpolation based on the relationship between the minimum set point for the minimum speed and the maximum set point for the maximum speed so as to find the value of the adjusted set point for the speed in order to maintain the substantially constant discharge pressure of the pump system.

7. A pump system according to claim 6, wherein the interpolation set point module is configured to respond to the speed signaling and the user input signaling, use interpolation to find the value of a set point Y for a speed X, and provide interpolation signaling containing information about the value of the set point Y for the speed X.

8. A pump system according to claim 7, wherein the pump system logic controller comprises a low pass filter module that is configured to respond to the interpolation signaling and provide low pass filter interpolation signaling containing low pass filtered information about the interpolation related to the value of the set point Y for the speed X that takes the form of the set point signaling provided to the constant pressure control model.

9. A pump system according to claim 1, wherein the constant pressure control model is configured to receive a flow from a pipe or distribution network having flow pipes to be pumped back into the pipe or distribution network, and also configured to respond to set point signaling, pump the flow at a substantially constant discharge pressure, and provide the speed signal containing information about the speed related to the constant pressure control model.

10. A pump system according to claim 1, wherein the user input signaling contains information about a minimum set point value, a maximum pressure loss, including where a Max Pressure Value=Set Point+Max Pressure Loss, and a minimum speed value.

11. A pump system according to claim 1, wherein the logic, comparator or PID controller is configured to respond to the set point signaling, determine the speed signaling, provide/feed the speed signaling determined back to the pump system logic controller, and also provide the speed signaling determined to the pump model.

12. A pump system according to claim 11, wherein the pump model is configured to receive a flow from the pipe and distribution network and also configured to respond to the set point signaling and pump the flow at the substantially constant discharge pressure.

13. A pump system according to claim 2, wherein the pump model is configured to provide discharge pressure signaling, that is fed back to the logic, or comparator, or PID controller; and the logic, or comparator, or PID controller is configured to respond to the discharge pressure signaling and determine the speed signaling, based at least partly on the discharge pressure signaling received.

14. A pump system according to claim 1, wherein the pump system comprises a variable speed multiple pump booster system; and the pump model comprises multiple pumps that may be selectively staged and destaged during the operation of the variable speed multiple pump booster system.

15. A pump system according to claim 1, wherein the signal processor or processing module is configured to determine a max pressure loss of the pump system and a defined control area of each pump; and determine a max loss of the one or more pumps, based upon the max pressure loss of the pump system and the defined control area of each pump.

16. A pump system according to claim 15, wherein the signal processor or processing module is configured to determine a value of max loss of the one or more pumps that is used to define the shape of setpoint control curve.

17. A method comprising:

responding, with a logic, comparator or proportional integral derivative (PID) controller in a constant pressure control model, to set point signaling and provide speed signaling, responding, with a pump model in the constant pressure control model, to the speed signaling and operating one or more running pumps in the pump model at a substantially constant discharge pressure;

responding, with a signal processor or processing module in a pump system logic controller, to the speed signaling and also to user input signaling containing information about a set point and a speed related to running the one or more pumps in the pump system; and determining, with the signal processor or processing module, the set point signaling containing information about an adjustment to the set point to compensate for system friction loss and maintain the substantially constant discharge pressure of the pump system for flow variation using an interpolation based on a relationship between a minimum set point for a minimum speed and a maximum set point for a maximum speed so as to find a value of an adjusted set point for the speed in order to maintain the substantially constant discharge pressure of the pump system, based at least partly on the user input signaling and the speed signaling received.

18. A method according to claim 17, wherein the method comprises providing the set point signaling to compensate for the system friction loss and maintain the substantially constant discharge pressure of the pump system.

19. A method according to claim 17, wherein the method comprises determining with the signal processor or processing module the number of the one or more pumps running in the constant pressure control model.

20. A method according to claim 19, wherein the method comprises determining with the signal processor or processing module the adjustment based at least partly on the number of the one or more pumps running and a defined control area related to the one or more pumps running.

21. A method according to claim 17, wherein the pump system is a variable speed multiple pump booster system.

* * * * *